US005727125A

United States Patent [19]

Bergstrom et al.

[11] Patent Number: 5,727,125

[45] Date of Patent: Mar. 10, 1998

[54] METHOD AND APPARATUS FOR SYNTHESIS OF SPEECH EXCITATION WAVEFORMS

[75] Inventors: Chad Scott Bergstrom, Chandler; Bruce Alan Fette, Mesa; Cynthia Ann Jaskie, Scottsdale; Clifford Wood, Tempe; Sean Sungsoo You, Chandler, all of Ariz.

[73] Assignee: Motorola, Inc., Schaumburg, Ill.

[21] Appl. No.: 349,639

[22] Filed: Dec. 5, 1994

[51] Int. Cl.[6] ..... G10L 5/02

[52] U.S. Cl. ..... 395/12.73; 395/2.16; 395/2.73; 395/2.74; 395/2.77; 395/2.72

[58] Field of Search ..... 395/2.73, 2.28, 395/2.16, 2.14, 2.17, 2.74, 2.71, 2.79, 2, 2.09, 2.77, 2.33, 2.72; 381/36–43

[56] References Cited

U.S. PATENT DOCUMENTS

| | | | |
|---|---|---|---|
| 4,991,214 | 2/1991 | Freeman et al. | 381/38 |
| 5,042,069 | 8/1991 | Chhatwal et al. | 381/31 |
| 5,127,053 | 6/1992 | Koch | 381/31 |
| 5,138,661 | 8/1992 | Zinser et al. | 381/35 |
| 5,175,769 | 12/1992 | Hejna, Jr. et al. | 381/34 |
| 5,327,521 | 7/1994 | Savic et al. | 395/2.81 |
| 5,353,374 | 10/1994 | Wilson et al. | 395/2.35 |
| 5,495,555 | 2/1996 | Swaminathan | 395/2.16 |
| 5,517,595 | 5/1996 | Kleijn | 395/2.14 |

OTHER PUBLICATIONS

IEE Proceedings, vol. 136, Pt 1, No. 2; Wood et al., "Excitation syhchronous formant analysis", pp. 110–118, Apr. 1989.

Military Communications in a Changing World Milcom, Makovicka et al., "Modular Voice Processor", pp. 1210–1214, vol. 3, Nov. 1991.

*Primary Examiner*—Allen R. MacDonald
*Assistant Examiner*—Richemond Dorvil
*Attorney, Agent, or Firm*—Sherry J. Whitney; Harold C. McGurk, IV

[57] ABSTRACT

A speech vocoder device and corresponding method synthesizes speech excitation waveforms. The method entails reconstructing (216) an excitation target from decoded speech data, creating (220) aligned excitation segments by normalizing (296), correlating (298), and aligning (300) a source segment and a target segment, reconstructing normalized intervening segments by ensemble interpolating (318) between the source segment and the target segment, denormalizing (320) the normalized intervening segments, and reconstructing (322) an excitation waveform from the denormalized intervening segments, the source segment, and the target segment.

22 Claims, 7 Drawing Sheets

METHOD AND APPARATUS FOR SYNTHESIS OF SPEECH EXCITATION WAVEFORMS

CROSS-REFERENCE TO RELATED APPLICATIONS

This application is related to co-pending U.S. patent applications entitled "Method and Apparatus for Parameterization of Speech Excitation Waveforms", filed concurrently herewith, "Method and Apparatus for Characterization and Reconstruction of Speech Excitation Waveforms", filed concurrently herewith, and co-pending U.S. patent application Ser. Nos. 08/068,325, filed on May 28, 1993, entitled "Pitch Epoch Synchronous Linear Predictive Coding Vocoder and Method", and 08/068,918, filed on May 28, 1993, entitled "Excitation Synchronous Time Encoding Vocoder and Method". All patent applications are assigned to the same assignee as the present application.

FIELD OF THE INVENTION

The present invention relates generally to the field of decoding signals having periodic components and, more particularly, to techniques and devices for digitally decoding speech waveforms.

BACKGROUND OF THE INVENTION

Voice coders, referred to commonly as "vocoders", compress and decompress speech data. Vocoders allow a digital communication system to increase the number of system communication channels by decreasing the bandwidth allocated to each channel. Fundamentally, a vocoder implements specialized signal processing techniques to analyze or compress speech data at an analysis device and synthesize or decompress the speech data at a synthesis device. Speech data compression typically involves parametric analysis techniques, whereby the fundamental or "basis" elements of the speech signal are extracted. These extracted basis elements are encoded and sent to the synthesis device in order to provide for reduction in the amount of transmitted or stored data. At the synthesis device, the basis elements may be used to reconstruct an approximation of the original speech signal. Because the synthesized speech is typically an inexact approximation derived from the basis elements, a listener at the synthesis device may detect voice quality which is inferior to the original speech signal. This is particularly true for vocoders that compress the speech signal to low bit rates, where less information about the original speech signal may be transmitted or stored.

A number of voice coding methodologies extract the speech basis elements by using a linear predictive coding (LPC) analysis of speech, resulting in prediction coefficients that describe an all-pole vocal tract transfer function. LPC analysis generates an "excitation" waveform that represents the driving function of the transfer function. Ideally, if the LPC coefficients and the excitation waveform could be transmitted to the synthesis device exactly, the excitation waveform could be used as a driving function for the vocal tract transfer function, exactly reproducing the input speech. In practice, however, the bit-rate limitations of a communication system will not allow for complete transmission of the excitation waveform.

Accurate synthesis of the excitation waveform is difficult to achieve at low bit rates because low-rate vocoder implementations that capitalize on the periodic nature of the excitation waveform can fail to adequately preserve the overall excitation envelope structure and pitch evolution characteristic. Distortion of the excitation envelope and pitch evolution characteristic, which describes the evolution of the pitch between speech analysis segments, can lead to perceived distortion in the synthesized speech. Distortion of the excitation envelope and pitch evolution characteristic is caused by inadequate correlation and interpolation techniques of prior-art methods.

Analysis of speech by an analysis device is usually performed on a "frame" of excitation that comprises multiple epochs or pitch periods. Low bit rate requirements mandate that information pertaining to fewer than all of the epochs (e.g., only a single epoch within the frame) is desirably encoded. Generally, a source epoch and a target epoch are selected from adjacent frames. The epochs are typically separated by one or more intervening epochs. Excitation parameters characterizing the source epoch and the target epoch are extracted by the analysis device and transmitted or stored. Typically, excitation parameters characterizing the intervening epochs are not extracted. At the synthesis device, the source and target epochs are reconstructed. The intervening epochs are then reconstructed by correlation and interpolation methods.

In prior-art analysis methods, part of the characterization of the excitation waveform entails a step of correlating the source epoch and the target epoch using methods well known by those of skill in the an. Correlation entails calculating a correlation coefficient for each of a set of finite offsets or delays, between a first waveform and a second waveform. The largest correlation coefficient generally maps to the optimum delay between the waveforms that ensures the best interpolation outcome.

Prior-art epoch-synchronous methods have utilized adjacent frame source-target correlation in order to improve the character of the interpolated excitation envelope. Distortion of the excitation waveform can be caused by inadequate prior-art correlation methods. In prior-art methods, correlation is often performed on excitation epochs of non-uniform lengths. Epochs may have non-uniform lengths where a source epoch at a lower pitch contains more samples than a target epoch at a higher pitch or vice-versa. Such pitch discontinuities can lead to sub-optimal source-target alignment, and subsequent distortion in the face of interpolation.

Correlation methods at the analysis device typically introduce a correlation offset to the target epoch that aligns the excitation segments in order to improve the interpolation process. This offset can adversely effect time or frequency domain excitation characterization methods by increasing the variance of the characterized waveform. Increased variance in the pre-characterized waveform can lead to elevated quantization error. Inadequate correlation techniques can result in sub-optimally positioned or distorted excitation elements at the synthesis device, leading to distorted speech upon interpolation and subsequent synthesis.

Frame-to-frame interpolation of excitation components is essential in LPC-based low bit rate voice coding applications. Prior-art excitation-synchronous interpolation methods involve direct frame-to-frame ensemble interpolation techniques. Due to inter-frame pitch variations, these prior-an ensemble interpolation techniques are discontinuous and make no provision for smooth, natural waveform evolution. Prior-art interpolation methods introduce artifacts to the synthesized speech due to their inability to account for epoch length variations. Excitation epochs can expand or contract in a continuous fashion from one frame to the next as the pitch period changes. Artifacts can arise from ensemble interpolation between excitation epochs of differing periods in adjacent frames. Abrupt frame-to-frame period variations lead to unnatural, discontinuous deviations in the interpolated excitation waveforms.

Global trends toward complex, high-capacity telecommunications emphasize a growing need for high-quality speech coding techniques that require less bandwidth. Near-future telecommunications networks will continue to demand very high-quality voice communications at the lowest possible bit rates. Military applications, such as cockpit communications and mobile radios, demand higher levels of voice quality. In order to produce high-quality speech, limited-bandwidth systems must be able to accurately reconstruct the salient waveform features after transmission or storage.

Thus, what are needed are a method and apparatus that implements correlation alignment at the synthesis device and improves excitation alignment in the face of varying pitch. What are further needed are a method and apparatus for generating an estimate of the speech excitation waveform that produces high-quality speech. What are further needed are an interpolation strategy that overcomes interpolation artifacts introduced by prior-art methods.

DETAILED DESCRIPTION OF THE DRAWINGS

The present invention provides an excitation waveform synthesis technique and apparatus that result in higher quality speech at lower bit rates than is possible with prior-art methods. Generally, the present invention introduces a new excitation synthesis method and apparatus that serve to maintain high voice quality. This method is applicable for implementation in new and existing voice coding platforms that require efficient, accurate excitation synthesis algorithms. In such platforms, accurate synthesis of the LPC-derived excitation waveform is essential in order to reproduce high-quality speech at low bit rates.

One advantage of the present invention is that it improves excitation alignment in the face of varying pitch by performing correlation at the synthesis device on normalized source and target epochs.

Another advantage of the present invention is that it overcomes interpolation artifacts resulting from prior-art methods by period-equalizing the source and target excitation epochs in adjacent frames prior to interpolation.

In a preferred embodiment of the present invention, the vocoder apparatus desirably includes an analysis function that performs parameterization and characterization of the LPC-derived speech excitation waveform, and a synthesis function that performs synthesis of an excitation waveform estimate. In the analysis function, basis excitation waveform elements are extracted from the LPC-derived excitation waveform by using a parameterization method. This results in parameters that accurately describe the LPC-derived excitation waveform at a significantly reduced bit-rate. In the synthesis function, these parameters may be used to reconstruct an accurate estimate of the excitation waveform, which may subsequently be used to generate a high-quality estimate of the original speech waveform.

A. Vocoder Apparatus

Figure 1:
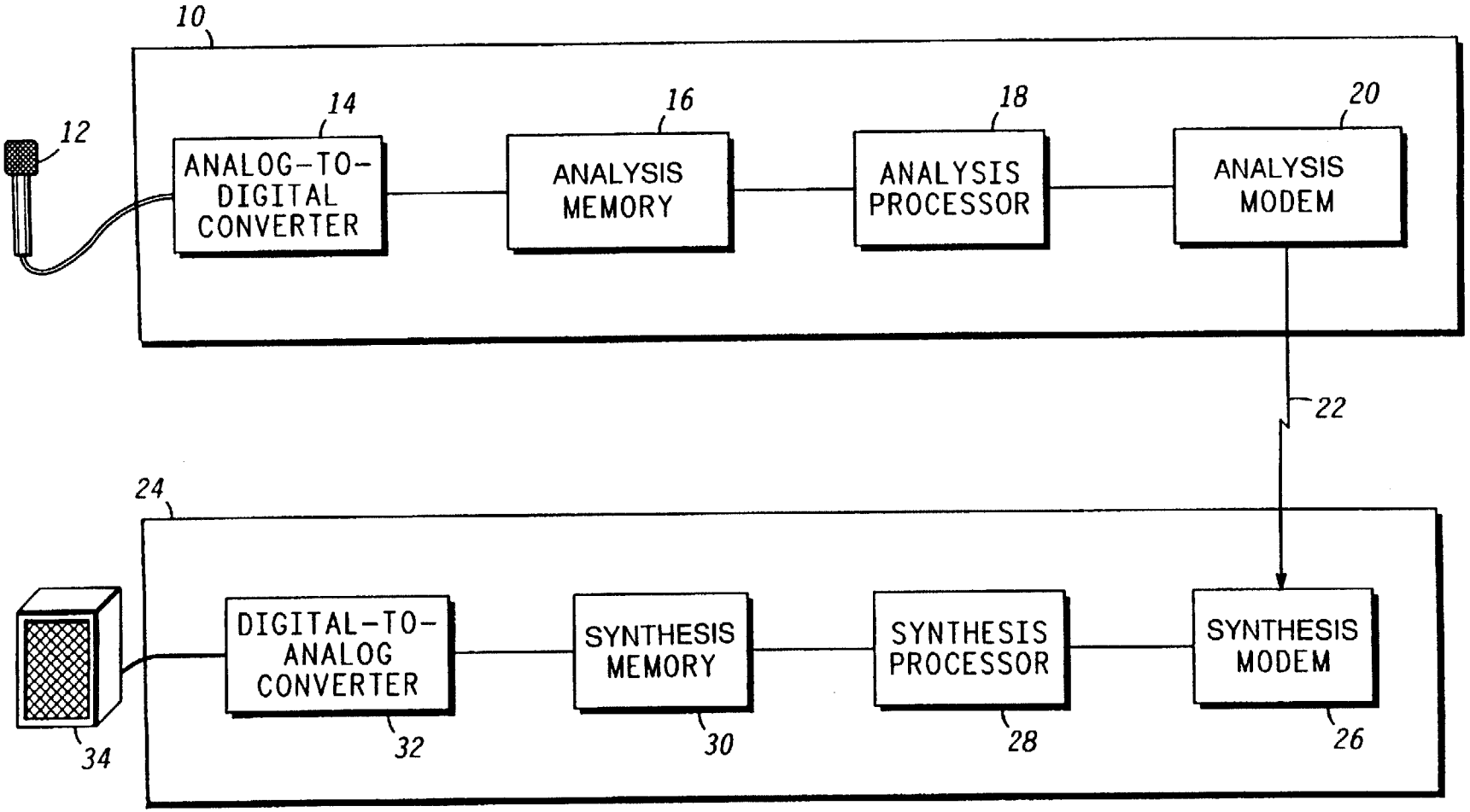
FIG. 1 shows an illustrative vocoder apparatus in accordance with a preferred embodiment of the present invention.

FIG. 1 shows an illustrative vocoder apparatus in accordance with a preferred embodiment of the present invention. The vocoder apparatus comprises a vocoder analysis device 10 and a vocoder synthesis device 24. Vocoder analysis device 10 comprises analog-to-digital converter 14, analysis memory 16, analysis processor 18, and analysis modem 20. Microphone 12 is coupled to analog-to-digital converter 14 which converts analog voice signals from microphone 12 into digitized speech samples. Analog-to-digital converter 14 may be, for example, a 32044 codec available from Texas Instruments of Dallas, Tex. In a preferred embodiment, analog-to-digital converter 14 is coupled to analysis memory device 16. Analysis memory device 16 is coupled to analysis processor 18. In an alternate embodiment, analog-to-digital converter 14 is coupled directly to analysis processor 18. Analysis processor 18 may be, for example, a digital signal processor such as a DSP56001, DSP56002, DSP96002 or DSP56166 integrated circuit available from Motorola, Inc. of Schaumburg, Ill.

In a preferred embodiment, analog-to-digital converter 14 produces digitized speech samples that are stored in analysis memory device 16. Analysis processor 18 extracts the sampled, digitized speech data from analysis memory device 16. In an alternate embodiment, sampled, digitized speech data is stored directly in the memory or registers of analysis processor 18, thus eliminating the need for analysis memory device 16.

Analysis processor 18 performs the functions of preprocessing the speech waveform, LPC analysis, parameterizing the excitation, characterizing the excitation, and analysis post-processing. Analysis processor 18 also desirably includes functions of encoding the characterizing data using scalar quantization, vector quantization (VQ), split vector quantization, or multi-stage vector quantization codebooks. Analysis processor 18 thus produces an encoded bitstream of compressed speech data.

Analysis processor 18 is coupled to analysis modem 20 which accepts the encoded bitstream and prepares the bitstream for transmission using modulation techniques commonly known to those of skill in the art. Analysis modem 20 may be, for example, a V.32 modem available from Universal Data Systems of Huntsville, Ala. Analysis modem 20 is coupled to communication channel 22, which may be any communication medium, such as fiber-optic cable, coaxial cable or a radio-frequency (RF) link. Other media may also be used as would be obvious to those of skill in the art based on the description herein.

Vocoder synthesis device 24 comprises synthesis modem 26, synthesis processor 28, synthesis memory 30, and digital-to-analog converter 32. Synthesis modem 26 is coupled to communication channel 22. Synthesis modem 26 accepts and demodulates the received, modulated bitstream.

Synthesis modem 26 may be, for example, a V.32 modem available from Universal Data Systems of Huntsville, Ala.

Synthesis modem 26 is coupled to synthesis processor 28. Synthesis processor 28 performs the decoding and synthesis of speech. Synthesis processor 28 may be, for example, a digital signal processor such as a DSP56001, DSP56002, DSP96002 or DSP56166 integrated circuits available from Motorola, Inc. of Schaumburg, Ill.

Synthesis processor 28 performs the functions of synthesis pre-processing, desirably including decoding steps of scalar, vector, split vector, or multi-stage vector quantization codebooks. Synthesis processor 28 also performs the functions of reconstructing the excitation targets, aligning the excitation targets, interpolating the excitation, speech synthesis, and synthesis post-processing.

In a preferred embodiment, synthesis processor 28 is coupled to synthesis memory device 30. In an alternate embodiment, synthesis processor 28 is coupled directly to digital-to-analog converter 32. Synthesis processor 28 stores the digitized, synthesized speech in synthesis memory device 30. Synthesis memory device 30 is coupled to digital-to-analog converter 32 which may be, for example, a 32044 codec available from Texas Instruments of Dallas, Tex. Digital-to-analog converter 32 converts the digitized, synthesized speech into an analog waveform appropriate for output to a speaker 34 or other suitable output device.

For clarity and ease of understanding, FIG. 1 illustrates analysis device 10 and synthesis device 24 in separate physical devices. This configuration would provide simplex communication (i.e., communication in one direction only). Those of skill in the art would understand based on the description that an analysis device 10 and synthesis device 24 may be located in the same unit to provide half-duplex or full-duplex operation (i.e., communication in both the transmit and receive directions).

In an alternate embodiment, one or more processors may perform the functions of both analysis processor 18 and synthesis processor 28 without transmitting the encoded bitstream. The analysis processor would calculate the encoded bitstream and store the bitstream in a memory device. The synthesis processor could then retrieve the encoded bitstream from the memory device and perform synthesis functions, thus creating synthesized speech. The analysis processor and the synthesis processor may be a single processor as would be obvious to one of skill in the art based on the description. In the alternate embodiment, modems (e.g., analysis modem 20 and synthesis modem 26) would not be required to implement the present invention.

B. Speech Synthesis Method

Encoding speech data by an analysis device (e.g., analysis device 24, FIG. 1) may include the steps of scalar quantization, vector quantization (VQ), split-vector quantization, or multi-stage vector quantization of excitation parameters. These methods are well known to those of skill in the art. The result of the encoding process is a bitstream that contains the encoded speech data.

After the basis elements of speech have been extracted, encoded, and transmitted or stored, they are decoded, reconstructed, and used to synthesize an estimate of the original speech data. The speech synthesis process is desirably carded out by synthesis processor 28 (FIG. 1).

Figure 2:
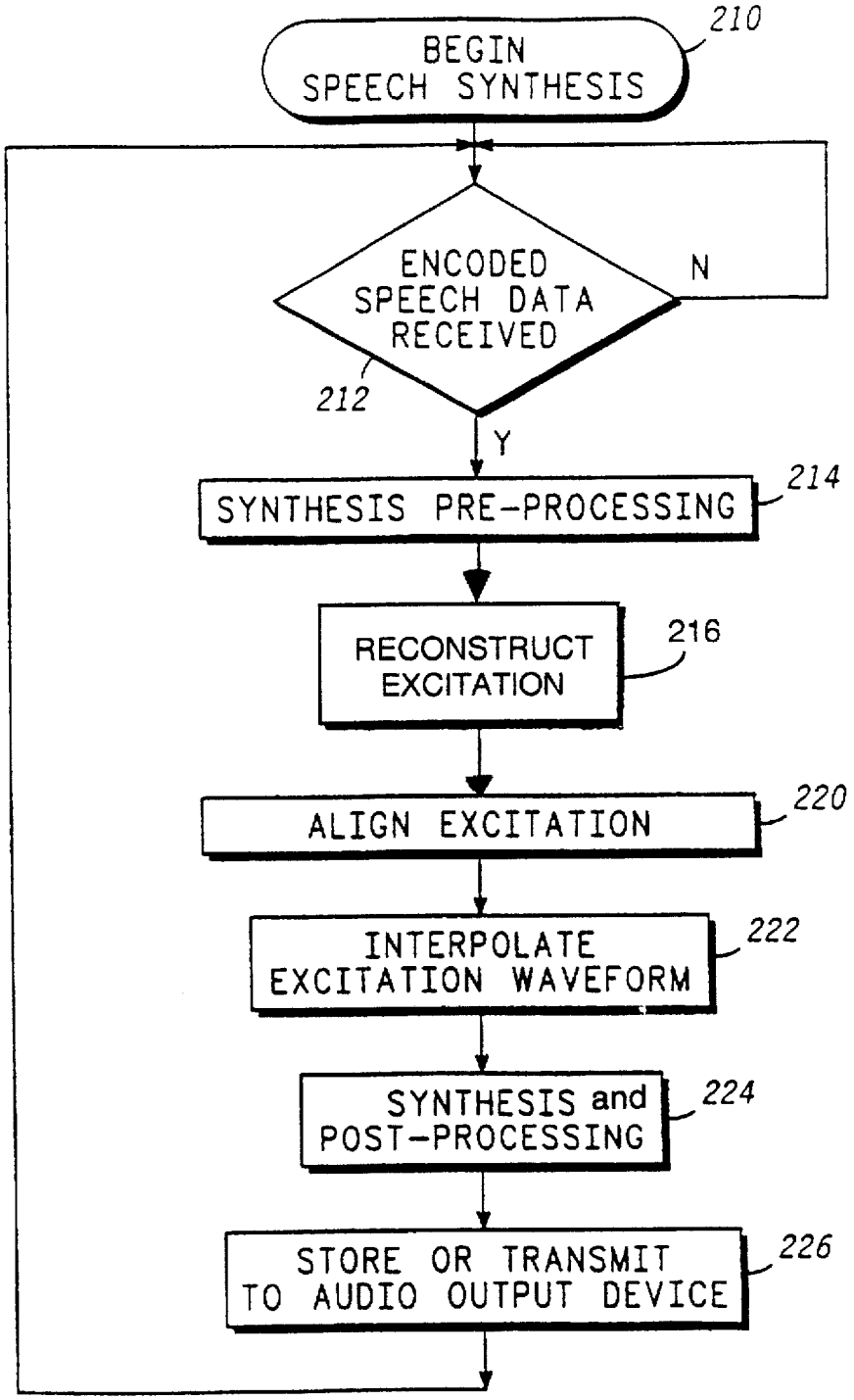
FIG. 2 illustrates a flowchart of a method for synthesizing speech in accordance with a preferred embodiment of the present invention.

FIG. 2 illustrates a flowchart of a method for synthesizing speech in accordance with a preferred embodiment of the present invention. The Speech Synthesis process begins in step 210 when encoded speech data is received in step 212. In an alternate embodiment, encoded speech data is retrieved from a memory device, thus eliminating the Encoded Speech Data Received step 212. Speech data may be considered to be received when it is retrieved from the memory device.

When no encoded speech data is received in step 212, the procedure iterates as shown in FIG. 2. When encoded speech data is received in step 212, the Synthesis PreProcessing step 214 generates decoded speech data using inverse steps (e.g., scalar quantization, VQ, split-vector quantization, or multi-stage vector quantization) than were used by analysis device 24 (FIG. 1 ) to encode the speech data. Through the Synthesis Pre-Processing step 214, the characterization data is reproduced.

The Reconstruct Excitation step 216 is then performed. The Reconstruct Excitation step 216 reconstructs the basis elements of the excitation that were extracted during the analysis process. Depending upon the characterization method used at the analysis device, the Reconstruct Excitation step 216 generates an estimate of the original excitation basis elements in the time or frequency domain. In one embodiment, for example, the characterization data may consist of decimated frequency domain magnitude and phase envelopes, which must be interpolated in a linear or non-linear fashion and transformed to the time domain. The resulting time domain data is typically an estimate of the epoch-synchronous excitation template or "target", that was extracted at the analysis device. In this embodiment, the reconstructed target segment or epoch from the prior frame (sometimes called the "source" epoch) must be used along with the reconstructed target segment or epoch in the current frame to estimate the intervening elided information, as discussed below.

Next, the Align Excitation process 220 creates aligned excitation waveforms by normalizing source and target excitation segments to common lengths and performing a correlation procedure to determine the optimum alignment index prior to performing interpolation. The Align Excitation process 220 is described in more detail in conjunction with FIG. 3.

Next, the Interpolate Excitation Waveform process 222 generates a synthesized excitation waveform by performing ensemble interpolation using the normalized, aligned source and target excitation segments and denormalizing the segments in order to recreate a smoothly evolving estimate of the original excitation waveform. The Interpolate Excitation Waveform process 222 is described in more detail in conjunction with FIG. 7.

After the Interpolate Excitation Waveform process 222, the Synthesis and PostProcessing step 224 is performed, which includes speech synthesis and direct or lattice synthesis filtering and adaptive post-filtering methods well known to those skilled in the art. The result of the Synthesis and Post-Processing step 224 is synthesized, digital speech data.

The synthesized speech data is then desirably stored 226 or transmitted to an audio-output device (e.g., digital-to-analog converter 32 and speaker 34, FIG. 1).

The Speech Synthesis process then returns to wait until encoded speech data is received 212, and the procedure iterates as shown in FIG. 2.

1. Align Excitation

In prior-art analysis methods, excitation characterization techniques include a step of correlating a source epoch and a target epoch extracted from adjacent frames. Using prior-art correlation methods, adjacent frame source-target correlation is used in order to improve the character of the interpolated excitation envelope. Such alignment methods have typically been implemented prior to characterization at the analysis device. In some cases, distortion of the excitation waveform can result using these prior-art methods. Correlation in the presence of varying pitch (i.e., epochs of different length) can lead to sub-optimal source-target alignment, and consequently, excitation distortion upon interpolation.

Furthermore, correlation at the analysis device introduces a correlation offset to the target epoch that aligns the excitation segments. This offset can adversely effect time or frequency domain excitation characterization methods by increasing the variance of the pre-characterized waveform. Increased variance in the precharacterized waveform can lead to elevated quantization error that ultimately results in degradation of the synthesized speech waveform.

The Align Excitation process 220 (FIG. 2) provides a method that implements the correlation offset at the synthesis device, consequently reducing excitation target variance and associated quantization error. Hence, speech quality improvement may be obtained over prior-art methods. By performing the Align Excitation process 220 (FIG. 2) exclusively at the synthesis device on normalized waveforms, alignment offset is not imposed on the target waveform prior to characterization. Improved alignment is obtained in the presence of frame-to-frame pitch variations by using normalized (i.e., uniform length) waveforms. By performing the Align Excitation process 220 (FIG. 2) at the synthesis device on normalized excitation waveforms, quantization error will be reduced and the excitation envelope will be better maintained during interpolation. Thus quality of the synthesized speech is increased.

Figure 3:
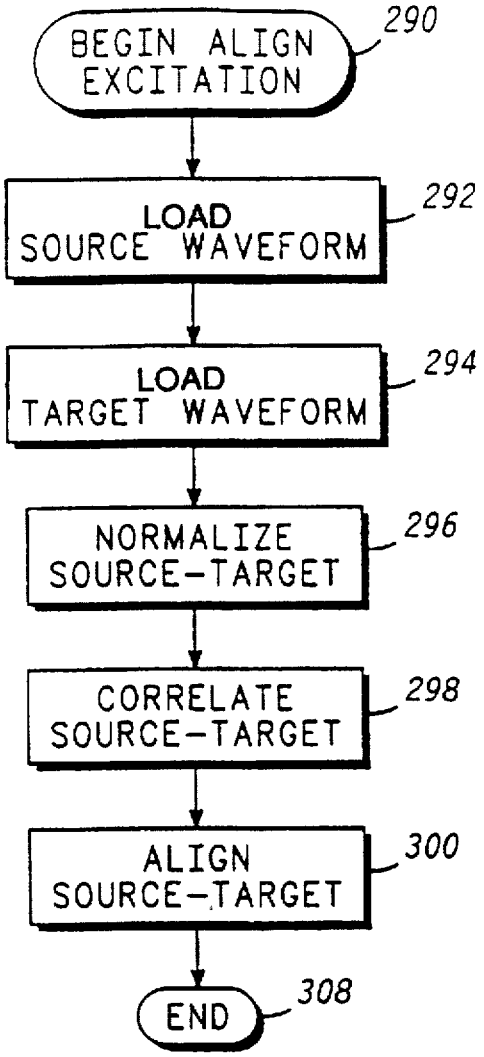
FIG. 3 illustrates a flowchart of an align excitation process in accordance with a preferred embodiment of the present invention.
Figure 4:
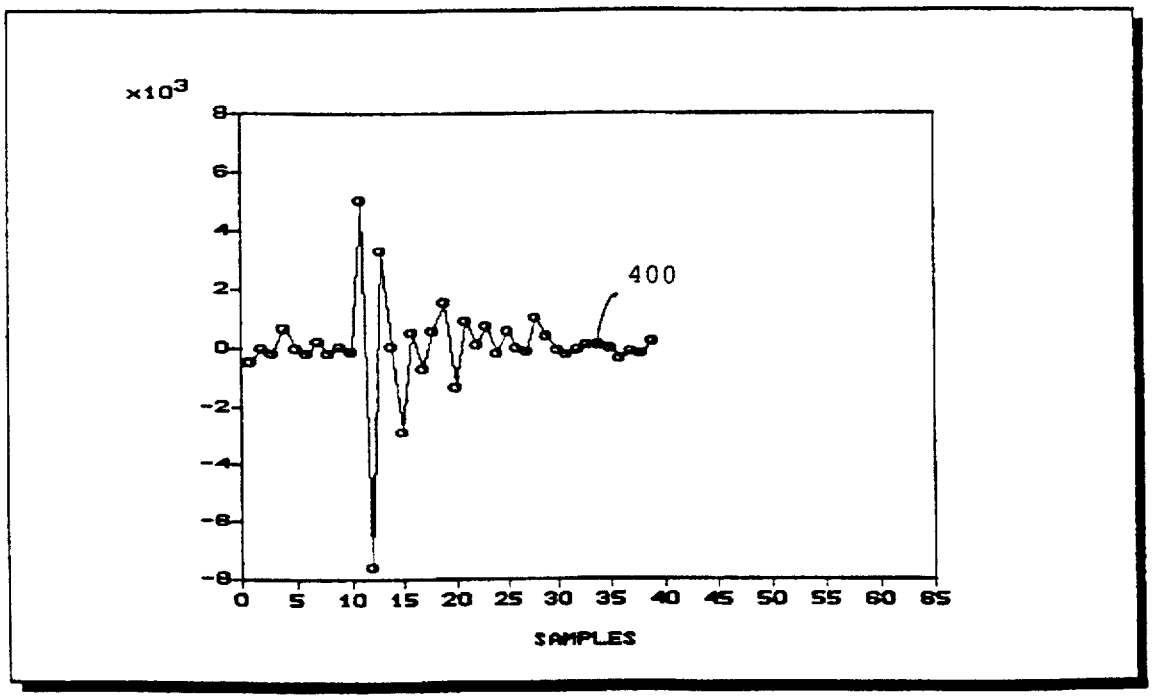
FIG. 4 illustrates an exemplary source epoch.

FIG. 3 illustrates a flowchart of the Align Excitation process 220 (FIG. 2) in accordance with a preferred embodiment of the present invention. The Align Excitation process begins in step 290 by performing the Load Source Waveform step 292. In a preferred embodiment, the Load Source Waveform step 292 retrieves an N-sample "source" from synthesis memory, usually the prior N-sample excitation target (i.e., from a prior calculation) and loads it into an analysis buffer. However, the source could be derived from other excitation as would be obvious to one of skill in the art based on the description herein. FIG. 4 illustrates an exemplary source epoch 400 with a length of 39 samples. Typically, the sample length relates to the pitch period of the waveform.

Figure 5:
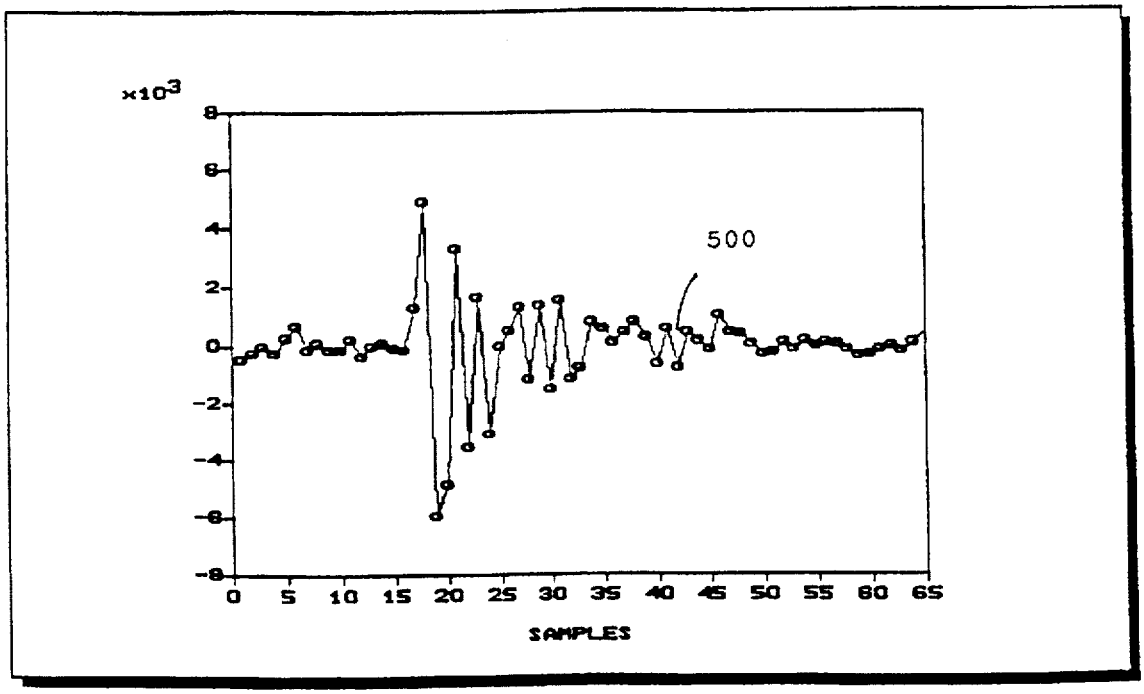
FIG. 5 illustrates an exemplary target epoch.

Next, the Load Target Waveform step 294 retrieves an M-sample "target" waveform from synthesis memory and loads it into a second analysis buffer (which may be the same analysis buffer as used by the Load Source Waveform step 292 as would be obvious to one of skill in the art based on the description herein). In a preferred embodiment, the target waveform is identified as the reconstructed current M-sample excitation target. However, the target could be derived from other excitation as would be obvious to one of skill in the art based on the description herein. FIG. 5 illustrates an exemplary target epoch 500 with a length of 65 samples. As would be obvious to one of skill in the art based on the description herein, the order of performance of the Load Source Waveform step 292 and the Load Target Waveform step 294 may be interchanged.

Figure 6:
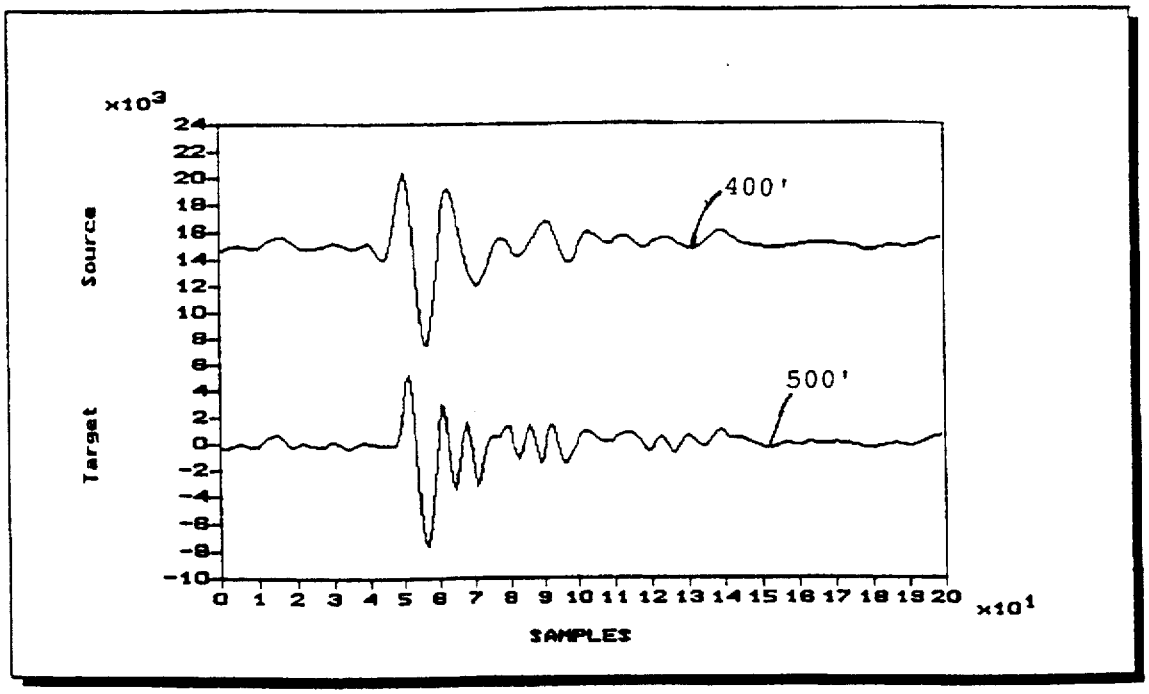
FIG. 6 illustrates normalized epochs derived in accordance with a preferred embodiment of the present invention from a source epoch and a target epoch.

Next, the Normalize Source-Target step 296 creates a normalized source and normalized target waveform by expanding the source and target waveforms to a same sample length L, where L is desirably greater than or equal to the larger of N and M. In an alternate embodiment, L may be less than M or N. FIG. 6 illustrates normalized epochs 400', 500' derived in accordance with a preferred embodiment of the present invention from source epoch 400 (FIG. 4) and target epoch 500 (FIG. 5). Both epochs 400', 500' are normalized to 200 samples although other normalizing lengths are appropriate. The Normalize Source-Target step 296 can utilize linear or nonlinear interpolation techniques well known to those of skill in the art to expand the source and target waveforms to the appropriate length. In a preferred embodiment, nonlinear interpolation methods are used.

Next, the Correlate Source-Target step 298 calculates waveform correlation data by cross-correlating the normalized source and target waveforms over an appropriately small range of delays. The Correlate Source-Target step 298 determines the maximum correlation index (i.e., offset) which provides the optimum alignment of epochs for subsequent source-target ensemble interpolation (see discussion of FIG. 7). Using normalized excitation epochs, improved accuracy is achieved in determining the optimum correlation offset over those prior-art methods that attempt to correlate epochs of non-uniform lengths.

Next, the Align Source-Target step 300 uses the maximum correlation index to align, or pre-position, the epochs as a pre-interpolation step. The maximum correlation index is used as a waveform offset prior to interpolation. The Align Source-Target step 300 provides for improved excitation envelope reproduction given interpolation. The Align Source-Target step 300 reduces excessive excitation envelope distortion arising from improperly aligned epochs.

The Align Excitation process then exits in step 308.

2. Interpolate Excitation Waveform

Prior-art excitation-synchronous interpolation methods have been shown to introduce artifacts to synthesized speech due to their inability to account for epoch length variations. Abrupt flame-to-flame period variations lead to unnatural, discontinuous deviations in the interpolated excitation waveforms.

The Interpolate Excitation Waveform process 222 (FIG. 2) is an interpolation strategy that overcomes interpolation artifacts introduced by prior-art methods. The Interpolate Excitation Waveform process 222 (FIG. 2) is a technique for epoch "normalization" wherein the source and target excitation epochs in adjacent frames are period-equalized prior to interpolation.

Figure 7:
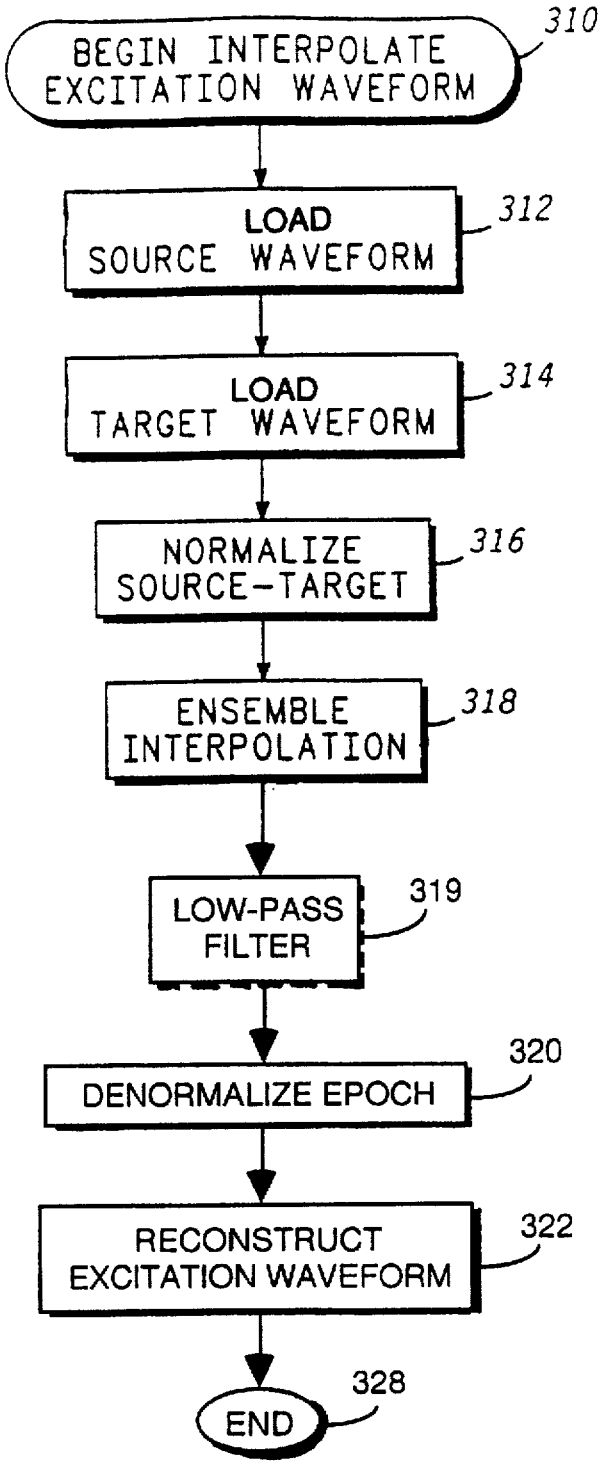
FIG. 7 illustrates a flowchart of an interpolate excitation waveform process in accordance with a preferred embodiment of the present invention.

FIG. 7 illustrates a flowchart of the Interpolate Excitation Waveform process 222 (FIG. 2) in accordance with a preferred embodiment of the present invention. The Interpolate Excitation Waveform process begins in step 310 by performing the Load Source Waveform step 312. In a preferred embodiment, the Load Source Waveform step 312 retrieves an N-sample "some" from synthesis memory and loads it into an analysis buffer. In a preferred embodiment, the source waveform is chosen as a prior N-sample excitation target. However, the source could be derived from other excitation as would be obvious to one of skill in the art based on the description herein.

Next, the Load Target Waveform step 314 retrieves an M-sample target waveform from synthesis memory and loads it into a second analysis buffer (which may be the same analysis buffer as used by the Load Source Waveform step 312 as would be obvious to one of skill in the art based on the description herein). In a preferred embodiment, the target waveform is identified as the reconstructed current M-sample excitation target. However, the target could be derived from other excitation as would be obvious to one of skill in the art based on the description herein. Typically, sample lengths N and M refer to the pitch period of the source and target waveforms, respectively. As would be obvious to one of skill in the art based on the description herein, the order of performance of the Load Source Waveform step 312 and the Load Target Waveform step 314 may be interchanged.

Next, the Normalize Source-Target step 316 generates a normalized source and a normalized target waveform by expanding the N-sample source and M-sample target to a common length of L samples, where L is desirably greater than or equal to the larger of M or N. In an alternate embodiment, L may be less than M or N. Normalization of the source excitation may be omitted for efficiency if this step has already been performed. For example, if the source epoch is a previous target epoch that has been normalized and saved to synthesis memory, the previously normalized epoch may be loaded 312 into the source analysis buffer, omitting the normalization step for this excitation segment. In this process, waveforms are expanded to a common length before interpolation is performed. Period equalization may be accomplished by using linear or nonlinear interpolation techniques that are well known to those of skill in the art. In a preferred embodiment, a nonlinear cubic spline interpolation technique is used that ensures a smooth envelope.

In a preferred embodiment, the Normalize Source-Target step 316 is implemented at the synthesis device after a reconstruction process (e.g., Reconstruct Excitation process 216, FIG. 2) reconstructs the source and target epochs. However, depending upon the particular method being used to characterize the excitation targets, the Normalize Source-Target step 316 can be implemented at either the analysis or synthesis device, as would be obvious to one of skill in the art based on the description herein. For example, if a frequency-domain characterization method is implemented at the analysis device, the Normalize Source-Target step 316 is preferably implemented at the synthesis device due to the increased epoch-to-epoch spectral variance caused by the normalization process. Such variance could introduce increased quantization error if the normalization method were performed at the analysis device prior to frequency-domain characterization and encoding. As such, the optimum placement of the Normalize Source-Target step 316 is contingent upon the target characterization method being employed by the voice coding algorithm. Note that the Load Source Waveform step 312, Load Target Waveform step 314, and Normalize Source-Target step 316 need not be performed if the Align Excitation process 220 has been performed prior to the Interpolate Excitation Waveform process 222, as would be obvious to one of skill in the art based on the description herein.

As described above, reconstructed waveforms are normalized by the Normalize Source-Target step 316 to ensure interpolation between waveforms of equal length.

After the Normalize Source-Target step 316, the Ensemble Interpolation step 318 reconstructs normalized, intervening epochs that were discarded at the analysis device by way of ensemble source-target interpolation. Hence, the Ensemble Interpolation step 318 interpolates between a normalized "source" epoch occurring earlier in the data stream, and a normalized "target" occurring later in the data stream.

Prior-art interpolation methods fail to overcome problems introduced by discontinuous pitch deviation between source and target excitation. For example, given a 39-sample source epoch, and a corresponding 65-sample target epoch, prior-art interpolation from the source to the target would typically be performed in order to reconstruct the intervening excitation epochs and to generate an estimate of the original excitation waveform. Ensemble interpolation would introduce artifacts in the synthesized speech due to the discontinuous nature of the source and target waveform lengths.

The method of the present invention, in order to avoid such interpolation discontinuities, expands the same 39-sample source and 65-sample target by the Normalize Source-Target step 316 to an arbitrary normalized length of, for example, 200 samples. Then, the Ensemble Interpolation step 318 interpolates between the normalized source and target waveforms, reproducing a smooth waveform evolution.

The Ensemble Interpolation step 318 is desirably followed by the Low-Pass Filter step 319, which low-pass filters the ensemble-interpolated excitation. The Low-Pass Filter step 319 employs techniques commonly known to those of skill in the art, and is performed as a pre-processing step prior to denormalization.

After the Low-Pass Filter step 319, the Denormalize Epoch step 320 creates denormalized intervening epochs by denormalizing the epochs to appropriate lengths or pitch periods, in order to provide a gradual pitch transition from one excitation epoch to the next. These intervening epoch lengths are desirably calculated by linear interpolation relative to the source and target lengths, as would be obvious to one of skill in the art based on the description. Denormalization to the intervening epoch lengths is performed using linear or nonlinear interpolation methods. In contrast to prior-art methods, this gradual waveform pitch evolution more closely approximates the original excitation behavior, and hence the method of the present invention enhances the quality of the synthesized speech.

Next, the Reconstruct Excitation Waveform step 322 combines the denormalized epochs to produce the final synthesized excitation waveform.

The Interpolate Excitation Waveform process then exits in step 328.

In summary, this invention provides an excitation synthesis method that improves upon prior-art excitation synthesis methods. Vocal excitation models implemented in most reduced-bandwidth vocoder technologies fail to reproduce the full character and resonance of the original speech, and are thus unacceptable for systems requiring high-quality voice communications.

The novel method is applicable for implementation in a variety of new and existing voice coding platforms that require more efficient, accurate excitation synthesis algorithms. Military voice coding applications and commercial demand for high-capacity telecommunications indicate a growing requirement for speech coding and synthesis techniques that require less bandwidth while maintaining high levels of speech fidelity. The method of the present invention responds to these demands by facilitating high quality speech synthesis at the lowest possible bit rates.

Thus, a method and apparatus for synthesis of speech excitation waveforms has been described which overcomes specific problems and accomplishes certain advantages relative to prior-art methods and mechanisms. The improvements over known technology are significant. Voice quality at low bit-rates is enhanced.

While a preferred embodiment has been described in terms of a telecommunications system and method, those of skill in the art will understand based on the description that the apparatus and method of the present invention are not limited to communications networks but apply equally well to other types of systems where compression of voice or other signals is important.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A method of synthesizing speech from encoded speech data comprising the steps of:

a) receiving the encoded speech data;

b) generating decoded speech data by decoding the encoded speech data;

c) reconstructing an excitation target from the decoded speech data;

d) creating aligned excitation segments by correlating and aligning a source segment and a target segment;

e) generating an excitation waveform by interpolating between the aligned excitation segments;

f) creating a synthesized speech waveform by synthesizing speech using the excitation waveform; and g) storing the synthesized speech waveform.

2. The method as claimed in claim 1, wherein step d) comprises the steps of:

d1) loading the source segment having a first number of samples;

d2) loading the target segment having a second number of samples, where one or more intervening segments originally were located between the source segment and the target segment;

d3) creating a normalized source segment and a normalized target segment from the source segment and the target segment by expanding the source segment and the target segment to a third number of samples;

d4) calculating segment correlation data by correlating the normalized source segment with the normalized target segment;

d5) determining a maximum segment correlation index from the segment correlation data; and d6) creating the aligned excitation segments by aligning the normalized source segment and the normalized target segment relative to the maximum segment correlation index.

3. The method as claimed in claim 1, wherein step e) comprises the steps of:

e1) loading the source segment having a first number of samples;

e2) loading the target segment having a second number of samples, where one or more intervening segments originally were located between the source segment and the target segment;

e3) generating a normalized source segment and a normalized target segment from the source segment and the target segment by expanding the source segment and the target segment to a third number of samples;

e4) reconstructing normalized intervening segments by performing ensemble interpolation on the normalized source segment and the normalized target segment;

e5) creating denormalized intervening segments by denormalizing the normalized intervening segments; and e6) generating the excitation waveform from the denormalized intervening segments, the source segment, and the target segment.

4. A method of synthesizing speech from encoded speech data comprising the steps of:

a) receiving the encoded speech data;

b) generating decoded speech data by decoding the encoded speech data;

c) reconstructing an excitation target from the decoded speech data;

d) creating aligned excitation segments by correlating and aligning a source segment and a target segment;

e) generating an excitation waveform by interpolating between the aligned excitation segments;

f) creating a synthesized speech waveform by synthesizing speech using the excitation waveform; and g) transmitting the synthesized speech waveform to an audio output device.

5. A method of synthesizing speech from encoded speech data comprising the steps of:

a) receiving the encoded speech data;

b) generating decoded speech data by decoding the encoded speech data;

c) reconstructing an excitation target from the decoded speech data;

d) loading a source segment having a first number of samples;

e) loading a target segment having a second number of samples, where one or more intervening segments originally were located between the source segment and the target segment;

f) creating a normalized source segment and a normalized target segment from the source segment and the target segment by expanding the source segment and the target segment to a third number of samples;

g) calculating segment correlation data by correlating the normalized source segment with the normalized target segment;

h) determining a maximum segment correlation index from the segment correlation data;

i) creating aligned excitation segments by aligning the normalized source segment and the normalized target segment relative to the maximum segment correlation index;

j) reconstructing normalized intervening segments by performing ensemble interpolation on the aligned excitation segments;

k) creating denormalized intervening segments by denormalizing the normalized intervening segments;

l) generating an excitation waveform from the denormalized intervening segments, the source segment, and the target segment;

m) creating a synthesized speech waveform by synthesizing speech using the excitation waveform; and n) transmitting the synthesized speech waveform to an audio output device.

6. The method as claimed in claim 5, wherein step d) comprises the step of loading the source segment, wherein the source segment is a prior target segment.

7. The method as claimed in claim 5, wherein step e) comprises the step of loading the target segment, wherein the target segment is the excitation target.

8. The method as claimed in claim 5, wherein step f) comprises the step of normalizing the source segment and the target segment using a nonlinear interpolation method.

9. The method as claimed in claim 5, wherein step k) comprises the step of denormalizing the normalized intervening segments using a nonlinear interpolation method.

10. The method as claimed in claim 5 further comprising the step of filtering the normalized intervening segments using a low-pass filter.

11. A method of synthesizing speech from encoded speech data comprising the steps of:

a) receiving the encoded speech data;

b) generating decoded speech data by decoding the encoded speech data;

c) reconstructing an excitation target from the decoded speech data;

d) loading a source segment having a first number of samples;

e) loading a target segment having a second number of samples, where one or more intervening segments originally were located between the source segment and the target segment;

f) creating a normalized source segment and a normalized target segment from the source segment and the target segment by expanding the source segment and the target segment to a third number of samples;

g) calculating segment correlation data by correlating the normalized source segment with the normalized target segment.;

h) determining a maximum segment correlation index from the segment correlation data;

i) creating aligned excitation segments by aligning the normalized source segment and the normalized target segment relative to the maximum segment correlation index;

j) reconstructing normalized intervening segments by performing ensemble interpolation on the aligned excitation segments;

k) creating denormalized intervening segments by denormalizing the normalized intervening segments;

l) generating an excitation waveform from the denormalized intervening segments, the source segment, and the target segment;

m) creating a synthesized speech waveform by synthesizing speech using the excitation waveform; and n) storing the synthesized speech waveform.

12. A method of synthesizing speech from encoded speech data comprising the steps of:

a) receiving the encoded speech data;

b) generating decoded speech data by decoding the encoded speech data;

c) reconstructing an excitation target from the decoded speech data;

d) loading a source segment having a first number of samples;

e) loading a target segment having a second number of samples, where one or more intervening segments originally were located between the source segment and the target segment;

f) generating a normalized source segment and a normalized target segment from the source segment and the target segment by expanding the source segment and the target segment to a third number of samples;

g) reconstructing normalized intervening segments by performing ensemble interpolation on the normalized source segment and the normalized target segment;

h) creating denormalized intervening segments by denormalizing the normalized intervening segments;

i) reconstructing an excitation waveform from the denormalized intervening segments, the source segment, and the target segment;

j) creating a synthesized speech waveform by synthesizing speech using the excitation waveform; and k) transmitting the synthesized speech waveform to an audio output device.

13. The method as claimed in claim 12, wherein step d) comprises the step of loading the source segment, wherein the source segment is a prior target segment.

14. The method as claimed in claim 12, wherein step e) comprises the step of loading the target segment, wherein the target segment is the excitation target.

15. The method as claimed in claim 12, wherein step f) comprises the step of normalizing the source segment and the target segment using a nonlinear interpolation method.

16. The method as claimed in claim 12, wherein step h) comprises the step of denormalizing the normalized intervening segments using a nonlinear interpolation method.

17. The method as claimed in claim 12 further comprising the step of filtering the normalized intervening segments using a low-pass filter.

18. A method of synthesizing speech from encoded speech data comprising the steps of:

a) receiving the encoded speech data;

b) generating decoded speech data by decoding the encoded speech data;

c) reconstructing an excitation target from the decoded speech data;

d) loading a source segment having a fast number of samples;

e) loading a target segment having a second number of samples, where one or more intervening segments originally were located between the source segment and the target segment;

f) generating a normalized source segment and a normalized target segment from the source segment and the target segment by expanding the source segment and the target segment to a third number of samples;

g) reconstructing normalized intervening segments by performing ensemble interpolation on the normalized source segment and the normalized target segment;

h) creating denormalized intervening segments by denormalizing the normalized intervening segments;

i) reconstructing an excitation waveform from the denormalized intervening segments, the source segment, and the target segment;

j) creating a synthesized speech waveform by synthesizing speech using the excitation waveform; and k) storing the synthesized speech waveform.

19. A speech vocoder synthesis device comprising:

a modem for receiving encoded speech data; and a digital signal processor, coupled to the modem, for generating decoded speech data by decoding the encoded speech data, reconstructing an excitation target from the decoded speech data, creating aligned excitation segments by normalizing, correlating, and aligning a source segment and a target segment, reconstructing normalized intervening segments by ensemble interpolating and denormalizing the normalized intervening segments, and reconstructing an excitation waveform.

20. The speech vocoder synthesis device as claimed in claim 19 further comprising:

a digital-to-analog converter coupled to the digital signal processor, for converting the decoded speech data into an analog waveform; and an audio output device, coupled to the digital-to-analog converter, for outputting the analog waveform.

21. The speech vocoder synthesis device as claimed in claim 19 further comprising a memory device, coupled to the digital signal processor, for storing the decoded speech data.

22. A speech vocoder synthesis device comprising:

means for decoding encoded speech data;

means for reconstructing an excitation target from the decoded speech data, coupled to the means for decoding;

means for creating aligned excitation segments by normalizing, correlating, and aligning a source segment and a target sediment, coupled to the means for reconstructing the excitation target;

means for reconstructing normalized intervening segments by ensemble interpolating and denormalizing the normalized intervening segments, coupled to the means for creating; and means for reconstructing an excitation waveform, coupled to the means for reconstructing the normalized intervening segments.

* * * * *